US008786164B2

(12) United States Patent
Hama

(10) Patent No.: US 8,786,164 B2
(45) Date of Patent: Jul. 22, 2014

(54) ACOUSTIC TRANSDUCER

(75) Inventor: Yoshinori Hama, Tokyo (JP)

(73) Assignee: NEC Corporation, Tokyo (JP)

( * ) Notice: Subject to any disclaimer, the term of this patent is extended or adjusted under 35 U.S.C. 154(b) by 194 days.

(21) Appl. No.: 13/333,146

(22) Filed: Dec. 21, 2011

(65) Prior Publication Data

US 2012/0161581 A1 Jun. 28, 2012

(30) Foreign Application Priority Data

Dec. 24, 2010 (JP) ..... P2010-287155

(51) Int. Cl.
*B06B 1/06* (2006.01)

(52) U.S. Cl.
USPC ..... 310/337; 310/369

(58) Field of Classification Search
USPC ..... 310/322, 369, 367, 337
See application file for complete search history.

(56) References Cited

U.S. PATENT DOCUMENTS

2007/0090723 A1* 4/2007 Keolian et al. ..... 310/311

FOREIGN PATENT DOCUMENTS

| | | | |
|---|---|---|---|
| JP | 60-196100 | A | 10/1985 |
| JP | H7-59196 | A | 3/1995 |
| JP | H7-231496 | A | 8/1995 |
| JP | H9-105778 | A | 4/1997 |
| JP | 2001333487 | A | 11/2001 |
| JP | 2010-141440 | A | 6/2010 |

OTHER PUBLICATIONS

Japanese Notice of Allowance for JP Application No. 2010-287155 mailed on Apr. 15, 2014 with partial English Translation.

* cited by examiner

*Primary Examiner* — Derek Rosenau
(74) *Attorney, Agent, or Firm* — Sughrue Mion, PLLC

(57) ABSTRACT

An acoustic transducer includes a ring oscillator. The ring oscillator includes: a first cushioning material; a pair of first and second annular members that are laminated in an axial direction thereof with the first cushioning material therebetween, each of the annular members having first and second ends in a circumferential direction thereof, and a notch portion formed between the first and second end; a first connecting portion that connects the first end of the first annular member and the second end of the second annular member; and a second connecting portion that connects the second end of the first annular member and the first end of the second annular member.

17 Claims, 4 Drawing Sheets

ACOUSTIC TRANSDUCER

This application is based upon and claims the benefit of priority from Japanese patent application No. 2010-287155, filed on Dec. 24, 2010, the disclosure of which is incorporated herein in its entirety by reference.

BACKGROUND OF THE INVENTION

1. Field of the Invention

The present invention relates to an electroacoustic transducer that emits sound waves into a liquid, and in particular, an acoustic transducer that can efficiently emit sound waves underwater.

2. Description of Related Art

As an acoustic transducer including a ring oscillator that emits sound waves into a liquid such as water, there is known a transducer provided with one or more annular members in the axial direction, which are formed such that the interior is hollow. This acoustic transducer, by turning on an electric current to the annular member and oscillating the entire ring oscillator, emits sound waves based on the oscillation into the liquid.

Examples of acoustic transducers include those disclosed in Japanese Unexamined Patent Application, First Publication No. 2001-333487 (hereunder, referred to as Patent Document 1), and Japanese Unexamined Patent Application, First Publication No. S60-196100 (hereunder, referred to as Patent Document 2).

The acoustic transducer disclosed in Patent Document 1 has a configuration in which a plurality of ring oscillators formed with a hollow interior are coaxially and consecutively provided in the axial direction, the axial direction upper end portion is supported by a ring, and the axial direction lower end portion is supported by a ring. Furthermore, the ring on the axial direction upper end portion and the ring on the axial direction lower end portion are fixed by means of a bolt, which penetrates through the hollow interior, and a nut. Moreover, on the periphery of the ring oscillator, a thin-walled axial direction diaphragm that vibrates in a bending vibrational mode is supported, and disk-shaped end face diaphragms that vibrate in a bending vibrational mode are respectively provided on both end portions of this axial direction diaphragm. Furthermore, broadband acoustic emission characteristics are able to be obtained by making the mechanical resonance frequencies of the axial direction diaphragm and the end face diaphragms different.

As a similar construction, a method has been proposed in which a plurality of thin-walled rectangular shaped diaphragms that are longer in the axial direction, and to which a piezoelectric oscillator that vibrates in a bending vibrational mode is attached, are arranged on the circumference, and the bending vibrations are utilized to perform acoustic emission underwater.

The acoustic transducer disclosed in Patent Document 2 includes a coil-shaped oscillator that is formed in a spiral shape by an electrostrictive material that generates distortions according to an applied voltage. Furthermore, the upper end portion and the lower end portion of the coil-shaped oscillator are fixed by a metal fitting. As a result, it is made possible for the vibrations generated in the coil-shaped oscillator to be converted into low-frequency radial direction vibrations according to the length of the coil-shaped oscillating body.

In acoustic transducers that perform acoustic emissions underwater by using the breathing vibrations of the ring oscillator, in the case of a construction in which both ends are sealed such that liquid does not flow in, and the interior is further filled with air or the like, there is a problem in that if it is driven at below the frequency of the resonance frequency of the breathing vibration mode of the ring oscillator, a highly efficient acoustic emission can not be obtained.

As the driving force that is generally utilized as the ring oscillator, ring-type piezoelectric oscillators such as piezoelectric ceramics, in which the construction and driving is simple, or polygon-shaped ring oscillators in which rectangular piezoelectric oscillators are aligned and laminated in a cylindrical shape, are used. Lead zirconate titanate serving as the piezoelectric material, is a material in which the mass and elasticity modulus are virtually the same as metals.

The resonance frequency of the ring oscillator is proportional to the square root of the elasticity modulus of the constituent material, and inversely proportional to the square root of the density, of the constituent material. In a case where the circumference length of the ring oscillator corresponds to one wavelength of the speed of sound of the constituent material, the ring oscillator vibrates in a breathing vibrational mode in which it uniformly fluctuates from a basic state, to a contracted state with a small diameter, and to an expanded state with a large diameter. This resonance frequency is very high because, as mentioned above, it is determined by the density and the elasticity modulus of the piezoelectric ceramic, and the speed of sound of the piezoelectric ceramic is approximately as fast as a metal.

Although there are piezoelectric ceramics referred to as a soft-type, which have a small elasticity modulus, it is not possible to greatly lower the resonance frequency.

In general, as the ring oscillator has a construction in which electrodes are arranged on the inner and outer faces, breathing vibrations of the ring oscillator are excited by a piezoelectric transverse effect, and acoustic emission is performed from the outside of the ring oscillator. Furthermore, it is common for the ring oscillator to be coated with a sheath or to be molded by means of a synthetic resin for protection, such that short-circuiting does not occur owing to the surrounding liquid.

End plates are arranged on the end faces of the ring oscillator, such that the liquid does not enter into the interior of the ring oscillator. Furthermore, a cushioning material, such as cork or laminated paper, is provided between the ring oscillator and the end plates, such that the end plates do not inhibit the breathing vibrations of the ring oscillator.

In order that the surrounding liquid does not enter into the interior from the gap between the end plates and the ring oscillator, this portion is also furnished with a sheath or a mold.

As another method, a ring oscillator is configured to approach a cylindrical shape by aligning rectangular piezoelectric oscillators which have an approximately rectangular parallelepiped shape in a polygonal shape via a wedge block having an approximately trigonal prism shape.

The acoustic transducers of the constructions mentioned above are able to perform acoustic emissions most efficiently at the time of the breathing vibrational mode, which occurs in a case where the cylinder length of the ring oscillator corresponds to one wavelength of the speed of sound of the constitution material.

According to common piezoelectric ceramic materials, in the case of a cylinder of a radius of approximately 10 cm, the resonance frequency of the breathing vibrational mode is approximately 5 to 10 kHz. In a case where it is utilized at below this frequency, since it deviates from the resonance frequency of the ring oscillator, the acoustic emission efficiency thereof will inevitably become low.

On the other hand, in a free-flooded type acoustic transducer in which end plates are not provided and water is also introduced into the interior of the ring oscillator, by utilizing the resonance of the breathing vibrational mode of the ring oscillator and the resonance of the water in the ring oscillator interior (water column resonance), acoustic emission with good efficiency can be performed.

In a case where the water column resonance is utilized at a frequency below the resonance frequency of the breathing vibrational mode, the acoustic emission efficiency inevitably becomes low. In other words, in regard to the frequency of the water column resonance, the resonance frequency is determined in an inverse relation to the height of the cylindrical oscillating body. Therefore, the frequency of the water column resonance can be designed independently from the breathing vibrations. However, the water column resonance cannot be obtained with a good efficiency if the frequencies of the two are separated, because the driving force is the breathing vibrational modes.

Even if one of the vibrations among the breathing vibrational mode or the water column resonance is to be utilized, in order to be used efficiently at a lower frequency, it is necessary to make the diameter of the cylinder larger, and as such, larger dimensions and mass are required as a result.

As a conventional example, in a case where it is made a spiral shape construction such as that disclosed in Patent Document 2, it is possible to lengthen the total length of the coil-shaped oscillating body, and it is possible to reduce the resonance frequency in the length direction thereof. However flexural vibrations of the entire coil lower than the resonance frequency of the oscillating body longitudinal direction are generated as a result of the structural asymmetry of the oscillating body, and there is a problem in that the required vibrations in the coil longitudinal direction do not necessarily become radial direction expansions and contractions of the cylinder, or in other words, breathing vibrations.

SUMMARY OF THE INVENTION

An exemplary object of the invention is to provide an acoustic transducer in which a lowering of the frequency, and a reduction in size and weight, can be achieved.

An acoustic transducer according to a first exemplary aspect of the present invention includes a ring oscillator. The ring oscillator includes: a first cushioning material; a pair of first and second annular members that are laminated in an axial direction thereof with the first cushioning material therebetween, each of the annular members having first and second ends in a circumferential direction thereof, and a notch portion formed between the first and second end; a first connecting portion that connects the first end of the first annular member and the second end of the second annular member; and a second connecting portion that connects the second end of the first annular member and the first end of the second annular member.

An acoustic transducer according to a second exemplary aspect of the present invention includes a ring oscillator. The ring oscillator includes: a plurality of first cushioning materials; a plurality of annular members that are laminated in an axial direction thereof with the cushioning materials therebetween, each of the annular members having first and second ends in a circumferential direction thereof, and a notch portion formed between the first and second end, the annular members including a first annular member provided at a top end in the axial direction, a second annular member provided at a bottom end in the axial direction, a third annular member adjacent to the first annular member in the axial direction; and a plurality of connecting portions which include first and second connecting portions, the first connecting portion connecting the first end of the first annular member and the second end of the second annular member, the second connecting portion connecting the second end of the first annular member and the first end of the third annular member.

According to the acoustic transducer of an exemplary embodiment of the present invention, the circumferential direction length of the ring oscillator can be made two times or multiple times the actual circumferential direction length, which is derived from the diameter of the annular member. In other words, it is possible to extend the propagation length of the longitudinal vibration by two times or multiple times, and the resonance frequency of the breathing vibration can be significantly lowered.

Accordingly, with regard to the ring oscillator, a low frequency can be realized without increasing the diameter of the annular member. As a result, compared to acoustic transducers using an annular member of a related art, a reduction in size and weight can be achieved.

Furthermore, in a coil-shaped configuration, flexural vibrations of the oscillating body occur from the asymmetry thereof. However in the case of the present configuration, the annular member is circumferentially uniformly arranged, except for a notch portion, and by making the apparent mass and elasticity modulus of the connection portion the same as the annular portion, flexural vibrations do not occur.

EXEMPLARY EMBODIMENT

Herein, an acoustic transducer of an exemplary embodiment of the present invention is described in detail with reference to the drawings.

Figure 1:
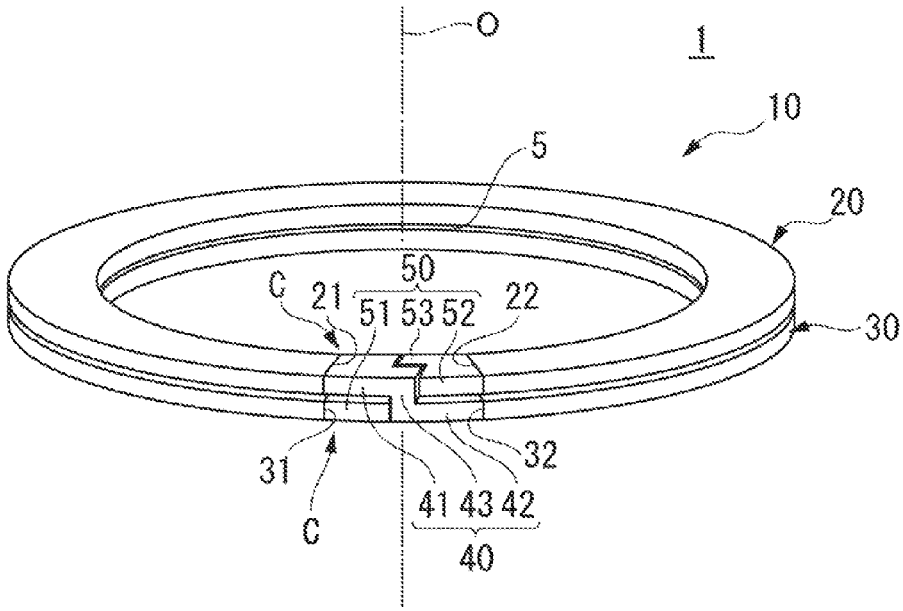
FIG. 1 is a perspective view of a ring oscillator of an acoustic transducer according to an exemplary embodiment of the present invention.

FIG. 1 is a perspective view of a ring oscillator 10 of an acoustic transducer 1 according to the exemplary embodiment. The ring oscillator 10 includes a first annular member 20, a second annular member 30, a first connection portion 40, and a second connection portion 50.

The first annular member 20 and the second annular member 30 are approximately annular-shaped members comprised by an elastically deformable material, such as steel.

The first and second annular members 20 and 30 are laminated in a state where the axes o thereof are mutually aligned. A cushioning material 5 is provided between the first annular member 20 and the second annular member 30. The cushioning material 5 includes a flexible material, such as cork or laminated paper. That is to say, the first annular member 20 and the second annular member 30 are laminated in the axis odirection with the cushioning material 5 interposed therebetween. By providing this cushioning material 5, mechanical attachment between the first annular member 20 and the second annular member 30 is avoided. It is preferable for the first annular member 20 and the second annular member 30 to be respectively composed of a piezoelectric ceramic single body or a piezoelectric ceramic laminated body.

The first annular member 20 and the second annular member 30 have notch portions C that are respectively formed such that a portion around the circumferential direction is cut away. In other words, by forming the notch portions C, the first annular member 20 and the second annular member 30 are respectively a C-shape. Both ends of the C-shape of the first annular member 20 are a first end portion 21 and a second end portion 22, which are mutually opposing in the circumferential direction. Similarly, both ends of the C-shape of the first annular member 30 are a first end portion 31 and a second end portion 32, which are mutually opposing in the circumferential direction. The first end portions 21 and 31 of the first annular member 20 and the second annular member 30 both face one side in the circumferential direction (that is, the first end portions 21 and 31 face a first direction along the circumferential direction). The second end portions 22 and 32 both face the other side in the circumferential direction (that is, the second end portions 22 and 32 face a second direction opposite to the first direction along the circumferential direction). In the present exemplary embodiment, the first annular member 20 and the second annular member 30 are laminated in the axis o direction in a state in which the respective notch portions C are aligned in the circumferential direction.

The first connection portion 40 is a member composed of steel or the like, in the same manner as the first annular member 20 and the second annular member 30. The first connection portion 40 connects the first end portion 21 of the first annular member 20 to the second end portion 32 of the second annular member 30. In other words, the first connection portion 40 has a first piece 41 which is connected to the first end portion 21 of the first annular member 20, a second piece 42 which is connected to the second end portion 32 of the second annular member 30, and a junction portion 43 that connects the first piece 41 and the second piece 42 in the axis o direction.

The second connection portion 50 is a member composed of steel or the like, in the same manner as the first connection portion 40. The second connection portion 50 connects the second end portion 22 of the first annular member 20 with the first end portion 31 of the second annular member 30. In other words, the second connection portion 50 has a first piece 51 which is connected to the first end portion 32 of the second annular member 30, a second piece 52 which is connected to the second end portion 32 of the first annular member 20, and a junction portion 53 that connects the first piece 51 and the second piece 52 in the axis o direction.

With this configuration, the first annular member 20 and the second annular member 30 are connected such that they mutually intersect in the axis o direction, by means of the first connection portion 40 and the second connection portion 50, which are respectively provided within the notch portions C. There is a space formed between the first connection portion 40 and the second connection portion 50. The cushioning material 5 may be arranged between the first and second connection portions 40 and 50 instead of the space.

It is preferable for the first connection portion 40 and the second connection portion 50 to be configured by a material and construction in which the apparent density and elasticity modulus are virtually the same as the first annular member 20 and the second annular member 30.

Generally, the breathing vibrations of the oscillator which is comprised of a single ring, are determined by the conditions in which a longitudinal vibration of a single wavelength occur in the circumference of the ring. The resonance frequency of the longitudinal vibration is uniquely defined by the density and the elasticity modulus of the material that configures the oscillator. Accordingly, in order to realize a resonance frequency at a lower frequency, the length corresponding to a single wavelength is made longer, or in other words, it can be realized by making the diameter of the oscillator, which comprises the ring, larger. However, in this case, the size of the oscillator itself becomes large, so there is the disadvantage in that it prevents it from being made compact.

In contrast to this, in the present exemplary embodiment, the annular member 20 and the second annular member 30 are mutually laminated in the axis o direction, and the first annular member 20 and the second annular member 30 are connected such that they intersect in the axis o direction by means of the first connection portion 40 and the second connection portion 50.

Accordingly, the circumferential direction dimension of the ring oscillator 10 is the sum of the first annular member 20 and the second annular member 30. In other words, the dimension of the ring oscillator 10 in the circumferential direction is two times the circumferential direction length in the cases of the first annular member 20 alone, or the second annular member 30 alone. As a result, it becomes possible to extend the propagation length of the longitudinal vibration by a factor of two, and the resonance frequency of the breathing vibrations can be generally lowered by half.

Consequently, according to the ring oscillator 10 of the present exemplary embodiment, as a result of connecting the first annular member 20 and the second annular member 30 such that they intersect in the axis o direction by means of the first connection portion 40 and the second connection portion 50, a low frequency of approximately one-half can be realized without increasing the diameter of the first annular member 20 or the second annular member 30. As a result, it becomes possible to achieve a reduction in size and weight.

The adjustment of the frequency can be easily performed by changing the circumferential direction length of the first connection portion 40 and the second connection portion 50. In other words, if the dimension of the first connection portion 40 and the second connection portion 50 in the circumferential direction thereof is made longer, the outer diameter of the ring oscillator 10 becomes larger and the frequency can be lowered. Furthermore, if the length of the first connection portion 40 and the second connection portion 50 is shortened, the outer diameter of the ring oscillator 10 becomes smaller and the frequency can be raised.

Figure 2:
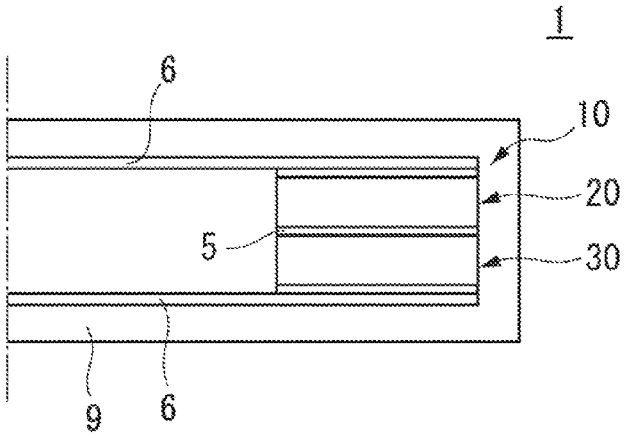
FIG. 2 is a vertical cross-sectional view of an example of an acoustic transducer according to the exemplary embodiment of the present invention.

The acoustic transducer 1 including the above ring oscillator 10 may be configured as shown in FIG. 2 for example. The acoustic transducer 1 shown in FIG. 2 includes ring oscillator 10, a pair of end plates 6, and a synthetic resin 9. The pair of end plates 6 are arranged on both axis o direction ends of the ring oscillator 10 so as to seal both end openings of the ring oscillator 10. The synthetic resin 9 is molded on the ring oscillator 10 and the end plates 6 such that it covers the whole of the ring oscillator 10 and the end plates 6. Such an acoustic transducer 1 is a configuration in which the external shape is a cylindrical shape, the interior is hollow, and acoustic emissions are achieved from the outer peripheral surface of the ring oscillator 10.

Figure 3:
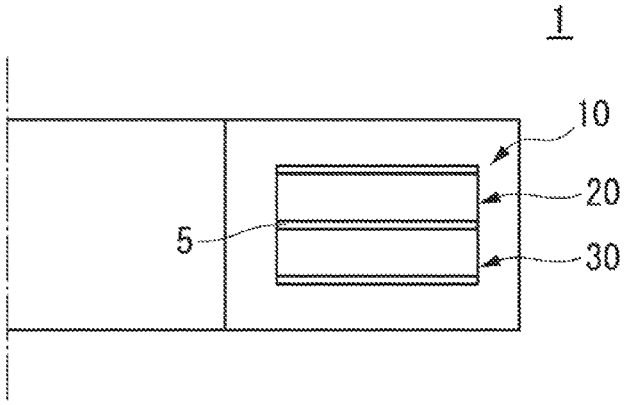
FIG. 3 is a vertical cross-sectional view of an example of an acoustic transducer according to the exemplary embodiment of the present invention.

Alternatively, as shown in FIG. 3 for example, the acoustic transducer 1 may be configured by encapsulating the whole of the ring oscillator 10 by means of the synthetic resin 9. In this case, the external shape of the acoustic transducer 1 becomes, in the same manner as the ring oscillator 10, a donut shape. In this case, liquid flows into the inside of the acoustic transducer 1, and the transducer 1 becomes a free-flooded ring construction utilizing underwater resonance of the liquid.

In these acoustic transducers 1, the ring oscillator may be coated by using a sheath instead of the synthetic resin 9.

Figure 4:
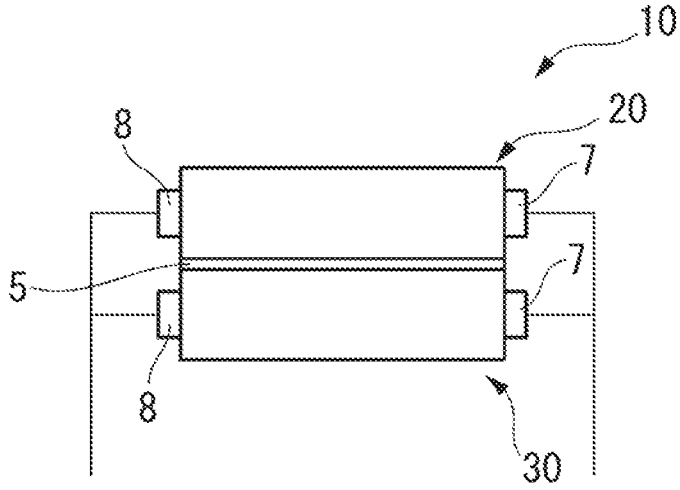
FIG. 4 is an example of an energizing method for the ring oscillator shown in FIG. 1.

In order to energize the ring oscillator 10, as shown in FIG. 4 for example, as electrodes, anodes 7 may be provided on the outer peripheral surface of the first annular member 20 and the second annular member 30, and cathodes 8 may be provided on the inner peripheral surface of the members 20 and 30.

Figure 5:
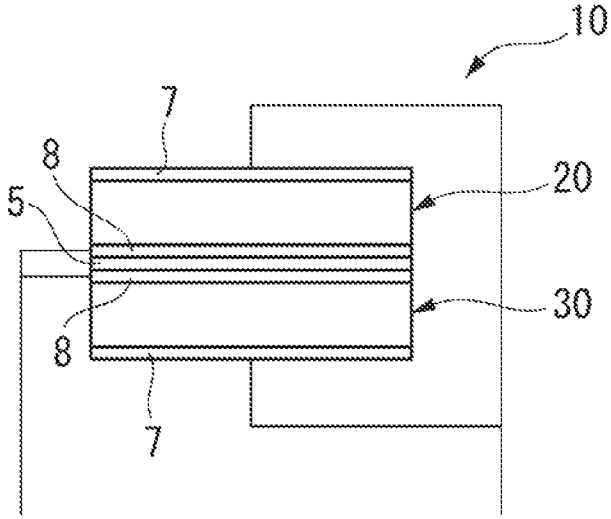
FIG. 5 is an example of an energizing method for the ring oscillator shown in FIG. 1.

Alternatively, as shown in FIG. 5 for example, the acoustic transducer 1 may include anodes 7 and cathodes 8. The anodes 7 are provided on the upper surface of the first annular member 20 and the lower surface of the second annular member 30, which correspond to the end portions of the ring oscillator 10. The cathodes 8 are provided on the lower surface of the first annular member 20 and the upper surface of the second annular member 30, which are mutually opposing.

Figure 6:
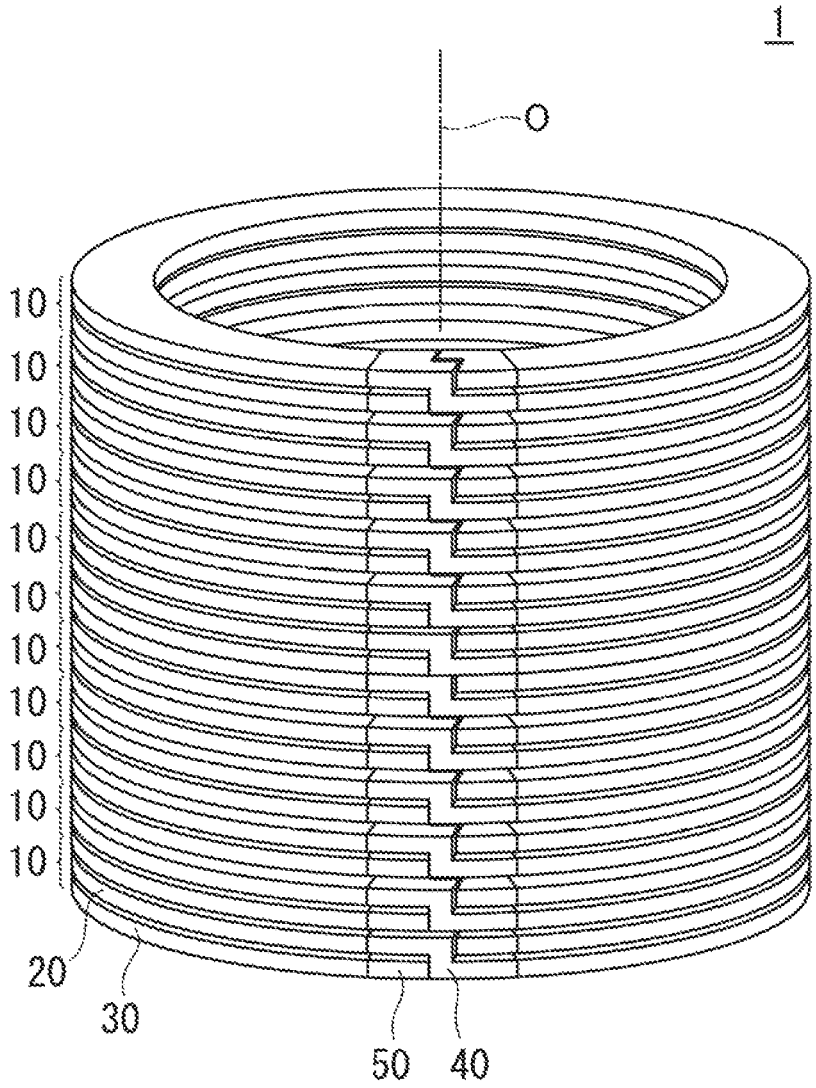
FIG. 6 is a perspective view of an acoustic transducer in which the ring oscillator shown in FIG. 1 is multiply laminated in the axial direction.

As shown in FIG. 6 for example, the acoustic transducer 1 may include a plurality of the ring oscillators 10 laminated in the axis o direction. Each of the ring oscillators 10 may be configured by laminating the first annular member 20 and the second annular member 30 in the axis o direction. In this case, the cushioning material 5 is provided between ring oscillators 10 that are mutually adjacent in the axis o direction. With this configuration, the axis o direction dimension can be freely set, and proportionally to this dimension, the water column resonance frequency can be reduced.

Figure 7:
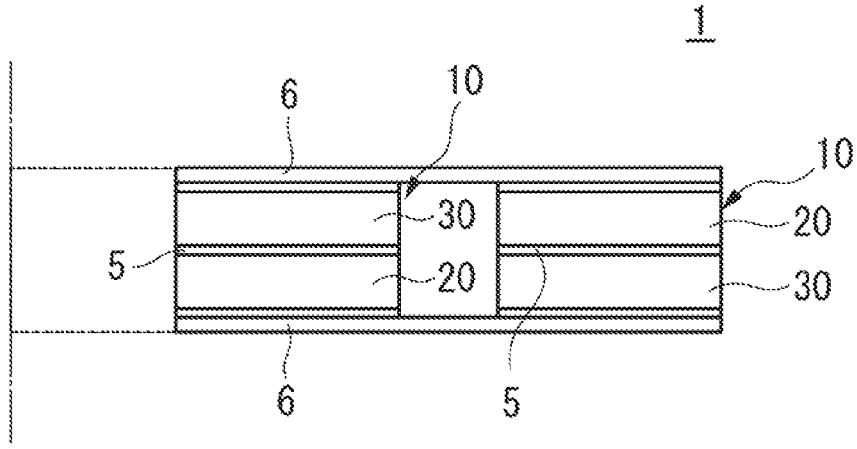
FIG. 7 is a vertical cross-sectional view of an acoustic transducer in which a pair of ring oscillators are mutually coaxially arranged with a space in the radial direction in the exemplary embodiment of the present invention.

As shown in FIG. 7 for example, the acoustic transducer 1 may include a pair of ring oscillators 10 arranged mutually coaxially with a space in the radial direction, and a pair of end plates 6 that seal both end openings of these ring oscillators 10.

In this case, the inside ring oscillator 10 and the outside ring oscillator 10 are mutually driven in opposite directions. As a result, an efficient acoustic emission, in which the phase of the acoustic pressure generation of the underwater resonance inside the ring oscillators 10 and the acoustic pressure generation from the outer surface of the ring oscillators 10 are matched, can be realized.

Figure 8:
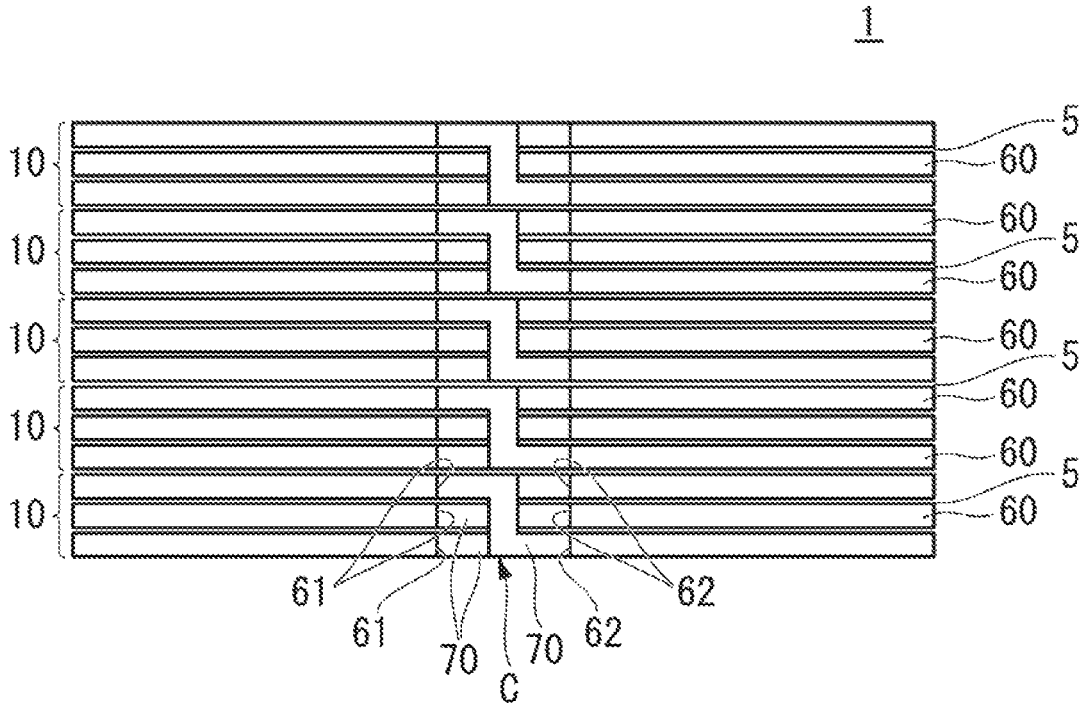
FIG. 8 is a side view of an acoustic transducer in which annular members are multiply laminated in the exemplary embodiment of the present invention.

The acoustic transducer 1 may include the ring oscillators 10 shown in FIG. 8 for example.

In regard to the ring oscillators 10 shown in FIG. 8, three annular members 60 which have the same configuration as the first annular member 20 and the second annular member 30, are laminated in the axis o direction via the cushioning materials 5.

The annular members 60 respectively have notch portions C. With this configuration, each of the annular members 60 has a first end portion 61 and a second end portion 62. The circumferential direction positions of the notch portions C of the annular members 60 are aligned.

The three annular members 60 consist of the first, second and third annular members 60 laminated in this order from the top to the bottom. The first end portion 61 of the first annular member 60 on the upper side and the second end portion 62 of the third annular member on the lower side are connected by means of the connection portion 70. The second end portion 62 of the first annular member 60 on the upper side and the first end portion 61 of the second annular member 60 in the middle are connected by means of the connection portion 70. The second end portion 62 of the second annular member 60 in the middle and the first end portion 61 of the third annular member 60 on the lower side are connected by means of the connection portion 70. These connection portions 70 have the same configuration as the first connection portion 40 and the second connection portion 50.

The acoustic transducer 1 shown in FIG. 8 is configured by a plurality of (five in this exemplary embodiment) of the above ring oscillators 10 which respectively include three annular members 60, and are laminated on each other in the axis o direction via the cushioning materials 5.

With this configuration, since the circumferential direction dimension of the ring oscillator 10 is the sum of the three annular members 60, it becomes possible to extend the propagation length of the longitudinal vibration by a factor of the number of annular members 60. Accordingly, the resonance frequency of the breathing vibration can be significantly reduced.

The ring oscillator 10 described above is configured by three annular members 60. However the constitution of the ring oscillator 10 is in no way limited to this. For example, a similar ring oscillator 10 may be configured by a plurality of four or more annular members 60. In other words, the ring oscillator 10 may be configured by sequentially connecting annular members 60 that are laminated in the axis o direction.

While the invention has been particularly shown and described with reference to exemplary embodiments thereof, the invention is not limited to these embodiments. It will be understood by those of ordinary skill in the art that various changes in form and details may be made therein without departing from the scope of the present invention as defined by the claims.

For example, in the exemplary embodiment, the circumferential direction positions of the notch portions C of the first annular member 20 and the second annular member 30, and the circumferential direction positions of the notch portions C of the plurality of annular members 60, are aligned. However the positions of these notch portions C may be arranged with a space around the circumferential direction.

In cases where the positions of the notch portions C are aligned in the circumferential direction, sections that are structurally non-uniform are formed. Therefore there is a possibility of introducing flexure vibrations in addition to the breathing vibrations. On the other hand, flexure vibrations can be avoided by arranging the notch portions C with a space around the circumferential direction, and preferably in an arrangement with equal spacing.

The first annular member 20, the second annular member 30, and the annular members 60 may be configured such that for example a plurality of rectangular piezoelectric oscillators that have a rectangular parallelepiped shape are aligned in an annular shape, by using wedge members that have a triangular prismatic shape.

What is claimed is:

1. An acoustic transducer comprising a ring oscillator, the ring oscillator comprising:

a first cushioning material;

a pair of first and second annular members that are laminated in an axial direction thereof with the first cushioning material therebetween, each of the annular members having first and second ends in a circumferential direction thereof, and a notch portion formed between the first and second ends;

a first connecting portion that connects the first end of the first annular member and the second end of the second annular member; and a second connecting portion that connects the second end of the first annular member and the first end of the second annular member, the first and second connecting portions being separate from each other, the first and second connecting portions being laminated to each other in the axial direction.

2. The acoustic transducer according to claim 1, further comprising:

a second cushioning material;

a plurality of ring oscillators, including the ring oscillator, laminated with the second cushioning material therebetween.

3. The acoustic transducer according to claim 1, wherein each of the notch portions of the annular members is arranged with a space around the circumferential direction.

4. The acoustic transducer according to claim 1, wherein the annular members include one of a piezoelectric ceramic single body and a piezoelectric ceramic laminated body.

5. The acoustic transducer according to claim 1, further comprising:

a pair of ring oscillators, including the ring oscillator, arranged mutually coaxially with a space in a radial direction thereof; and a pair of end plates that seal both end openings of the ring oscillators.

6. The acoustic transducer according to claim 1, wherein the first and second connecting portions are provided in the notch portions of the annular members.

7. An acoustic transducer comprising a ring oscillator, the ring oscillator comprising:

a plurality of first cushioning materials;

a plurality of annular members that are laminated in an axial direction thereof with the first cushioning materials therebetween, each of the annular members having first and second ends in a circumferential direction thereof, and a notch portion formed between the first and second ends, the annular members including a first annular member provided at a top end in the axial direction, a second annular member provided at a bottom end in the axial direction, a third annular member adjacent to the first annular member in the axial direction; and a plurality of connecting portions which include first and second connecting portions, the first connecting portion connecting the first end of the first annular member and the second end of the second annular member, the second connecting portion connecting the second end of the first annular member and the first end of the third annular member, the first and second connecting portions being separate from each other, the first and second connecting portions being laminated to each other in the axial direction.

8. The acoustic transducer according to claim 7, further comprising:

a second cushioning material; and a plurality of ring oscillators, including the ring oscillator, laminated with the second cushioning material therebetween.

9. The acoustic transducer according to claim 7, wherein each of the notch portions of the annular members is arranged with a space around the circumferential direction.

10. The acoustic transducer according to claim 7, wherein the annular members include one of a piezoelectric ceramic single body and a piezoelectric ceramic laminated body.

11. The acoustic transducer according to claim 7, further comprising:

a pair of ring oscillators, including the ring oscillator, arranged mutually coaxially with a space in a radial direction thereof; and a pair of end plates that seal both end openings of the ring oscillators.

12. The acoustic transducer according to claim 7, wherein the first and second connecting portions are provided in the notch portions of the annular members.

13. The acoustic transducer according to claim 7, wherein the connecting portions further include third connecting portion connecting the second end of the third annular member and the first end of the second annular member.

14. The acoustic transducer according to claim 1, wherein a space is formed between the first and second connecting portions.

15. The acoustic transducer according to claim 1, wherein each of the first and second connecting portions are provided between the first and second ends of the first annular member and between the first and second ends of the second annular member, and the first and second connecting portions intersect with each other.

16. The acoustic transducer according to claim 7, wherein a space is formed between the first and second connecting portions.

17. The acoustic transducer according to claim 7, wherein each of the first and second connecting portions are provided between the first and second ends of the first annular member and between the first and second ends of the third annular member, and the first and second connecting portions intersect with each other.

* * * * *